US008146479B2

(12) United States Patent
Cazalieres et al.

(10) Patent No.: US 8,146,479 B2
(45) Date of Patent: Apr. 3, 2012

(54) RETRACTABLE LIGHT TURRET

(75) Inventors: Jean-François Cazalieres, Saint Germain du Puy (FR); Jérôme Guillard, Lyons (FR)

(73) Assignee: Nexter Systems, Roanne (FR)

( * ) Notice: Subject to any disclaimer, the term of this patent is extended or adjusted under 35 U.S.C. 154(b) by 270 days.

(21) Appl. No.: 12/556,892

(22) Filed: Sep. 10, 2009

(65) Prior Publication Data

US 2011/0056367 A1 Mar. 10, 2011

(51) Int. Cl.

| | |
|---|---|
| ***F41H 5/20*** | (2006.01) |
| ***F41A 27/06*** | (2006.01) |
| ***F41A 23/20*** | (2006.01) |
| ***A62C 31/00*** | (2006.01) |

(52) U.S. Cl. ..... 89/36.13; 89/38; 89/935

(58) Field of Classification Search ..... 89/1.084, 89/1.815, 36.13, 37.12, 38, 39; 114/175
See application file for complete search history.

(56) References Cited

U.S. PATENT DOCUMENTS

| | | | | |
|---|---|---|---|---|
| 3,136,214 | A * | 6/1964 | Girouard et al. | 89/36.13 |
| 3,316,808 | A * | 5/1967 | Mais | 89/1.804 |
| 3,316,809 | A * | 5/1967 | Riedel | 89/1.815 |
| 3,401,598 | A * | 9/1968 | Sons, Jr. | 89/40.03 |
| 3,800,659 | A * | 4/1974 | Kuiper | 89/40.03 |
| 4,141,277 | A * | 2/1979 | Bouillon | 89/38 |
| 4,667,565 | A * | 5/1987 | Anderson | 89/36.08 |
| 4,681,013 | A * | 7/1987 | Farley et al. | 89/1.815 |
| 4,706,543 | A * | 11/1987 | Winkler et al. | 89/38 |
| 5,020,412 | A * | 6/1991 | Adams | 89/1.805 |
| 7,264,062 | B1 | 9/2007 | Ham | 169/52 |

FOREIGN PATENT DOCUMENTS

| | | |
|---|---|---|
| FR | 2 712 386 A1 | 5/1995 |
| WO | 2004/036138 A1 | 4/2004 |

* cited by examiner

*Primary Examiner* — Bret Hayes
(74) *Attorney, Agent, or Firm* — Steptoe & Johnson LLP

(57) ABSTRACT

A retractable light turret mounted in a platform, a firing device that can be deployed through an opening in a protective cowling for ensuring the closing of the opening, and elevation and azimuth aiming devices for the firing device, wherein the protective cowling has, on its external face, a close-in defense device, and at least one observation device coupled with a display device arranged inside the platform.

11 Claims, 3 Drawing Sheets

RETRACTABLE LIGHT TURRET

BACKGROUND OF THE INVENTION

1. Field of the Invention

The technical scope of the invention is that of light turrets mounted on a platform (fixed or mobile) and in particular turrets mounted on a military vehicle.

2. Description of the Related Art

It is known to produce an ammunition launching system that can be retracted inside an armoured vehicle. Patent FR2712386 describes such a system that incorporates several launcher tubes oriented in different directions and all integral with a pivoting hatch panel.

The advantage of such a system lies in that the tubes can be reloaded from inside the vehicle. This system has the drawback, however, of providing protection only with regard to threats located at medium or long distance (distance of over 15 m).

Furthermore, the opening of the hatch panel leaves the vehicle vulnerable to a threat at close range.

Within the scope of urban combat, there is the need today for a defence device that can also ensure the vehicle's protection at close, or very close, range.

SUMMARY OF THE INVENTION

The invention thus relates to a retractable light turret that ensures both the vehicle's or the platform's protection at medium or long range as well as protection at very close range.

Thus, the invention relates to a retractable light turret mounted on a platform, comprising firing means that can be deployed through an opening, a protective cowling ensuring the closing of the opening and elevation and azimuth aiming means for the firing means, such light turret wherein the protective cowling has, on its external face, firstly close-in defence means and secondly at least one observation means coupled with display means arranged inside the platform.

The close-in defence means may comprise at least one means to disperse a lachrymatory agent.

The close-in defence means may comprise at least one means to disperse a fire-extinguishing agent.

The means to disperse the lachrymatory and/or fire-extinguishing agents will be linked to at least one pressurised storage container inside the platform.

Advantageously, the protective cowling may also have at least one target-designation means on its external face.

According to another characteristic, the protective cowling is integral with the firing means and can pivot in azimuth with the firing means both in its open position and in its closed position, thereby enabling the close-in defence means and the observation means to be oriented.

The firing means can be moved from a retracted position into a deployed position by means of at least one pair of arms forming a deformable parallelogram.

One of the arms of this deformable parallelogram may have a length that can be modified by an actuator thereby enabling the aiming in elevation of the firing means when in the deployed position.

Advantageously, the firing means may comprise a unit incorporating at least two boreholes each accommodating a projectile.

The firing means unit may furthermore incorporate at least two boreholes of different calibres.

BRIEF DESCRIPTION OF THE DRAWINGS

The invention will become more apparent from the following description, such description made with reference to the appended drawings, in which.

DETAILED DESCRIPTION OF PREFERRED EMBODIMENTS

Figure 1:
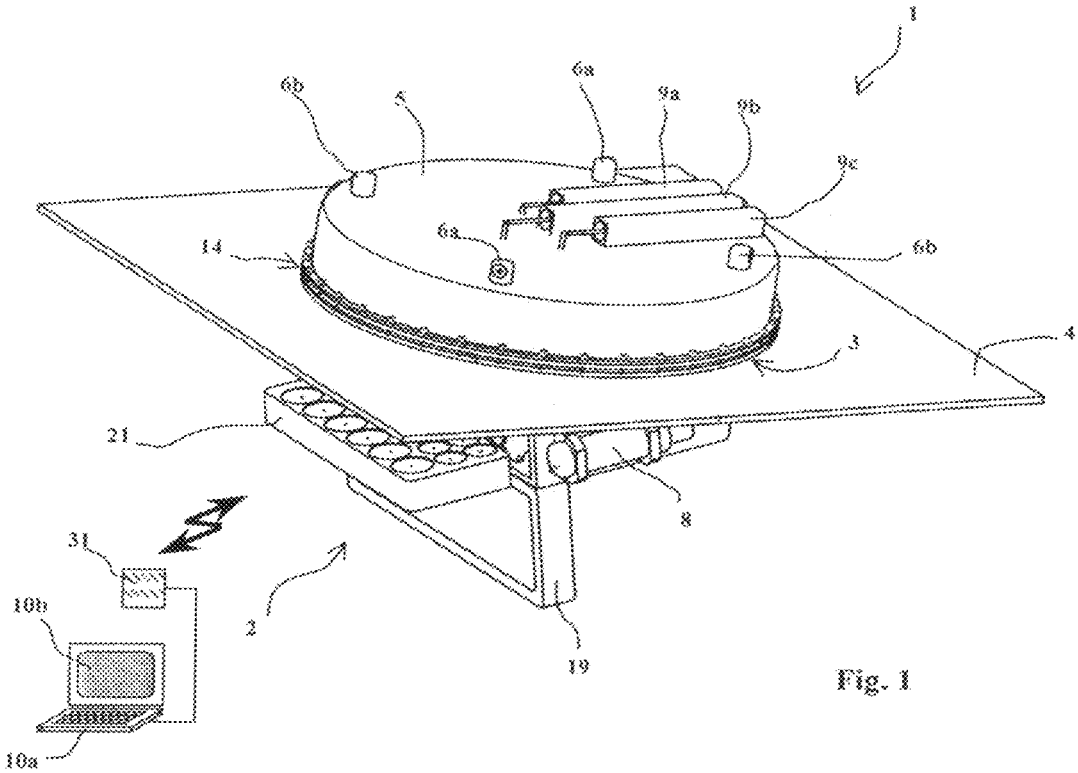
FIG. 1 is an external perspective view of a light turret according to one embodiment of the invention.
Figure 2:
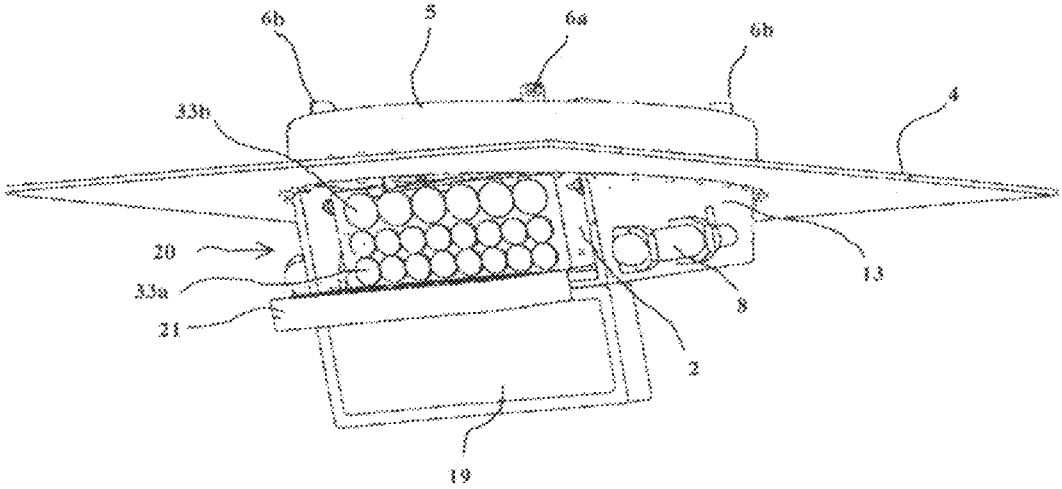
FIG. 2 is another perspective view of this same light turret.

FIGS. 1 and 2 show a light turret 1 according to the invention. This light turret comprises firing means 2 that may be deployed through a circular opening 3 arranged in a platform 4. The firing means 2 may pass through the opening 3 with the aid of deployment means that will be described hereafter. The platform 4 may be a vehicle or fixed facility.

The light turret also comprises a protective cowling 5 that ensures the closing of the opening 3. Furthermore, it also incorporates elevation and azimuth-aiming means for the firing means 2, such means also being described hereafter.

According to one characteristic of the invention, the protective cowling 5 has close-in defence means 6*a* and 6*b* on its external face. These means are constituted here by four dispersion nozzles, two nozzles 6*a* that disperse a lachrymatory agent and two other nozzles 6*b* that will ensure the dispersion of a fire-extinguishing agent.

Each dispersion nozzle is connected by a manifold 7*a*, 7*b* (see FIG. 3) to at least one pressurised storage container incorporating at least one valve with a commendable opening. This container 8 is internal to the platform 4 (here only one container can be seen).

According to another characteristic of the invention, the protective cowling 5 has at least one observation and/or aiming means 9 on its external face. Three means are shown here: 9*a*, 9*b* and 9*c*. These means are coupled with display means 10*b* arranged inside the platform. A first means 9*b* are aiming means, which here are constituted by a laser targeter. This targeter makes it easier to aim the firing means 2 of the light turret when the latter is in the deployed position.

Means 9*a* and 9*c*, which are arranged on either side of the laser targeter 9*b*, are constituted by day observation means (9*a*) and night observation means (9*c*). The observation means 9*a* and 9*c* will preferably be electronic cameras. These cameras (as well as the targeter 9*b*) will be connected to the display means which will incorporate a screen 10*b*. The targeter 9*b* may, furthermore, be activated from an interface linked to a computer 10*a*.

The Figures show that the cowling 5 here carries three observation and aiming means 9*a*, 9*b* and 9*c* installed in parallel. The close-in defence means 6*a* and 6*b* are furthermore arranged two by two diametrically to one another and the two diameters in question are orthogonal.

With such an arrangement, dispersion may be made from inside the platform in four different directions in space and self-defence coverage of 360° is ensured. The observation and aiming means 9*a*, 9*b* and 9*c* are directed in a firing direction that is the same as that of the firing means 2 themselves.

Figure 5A:
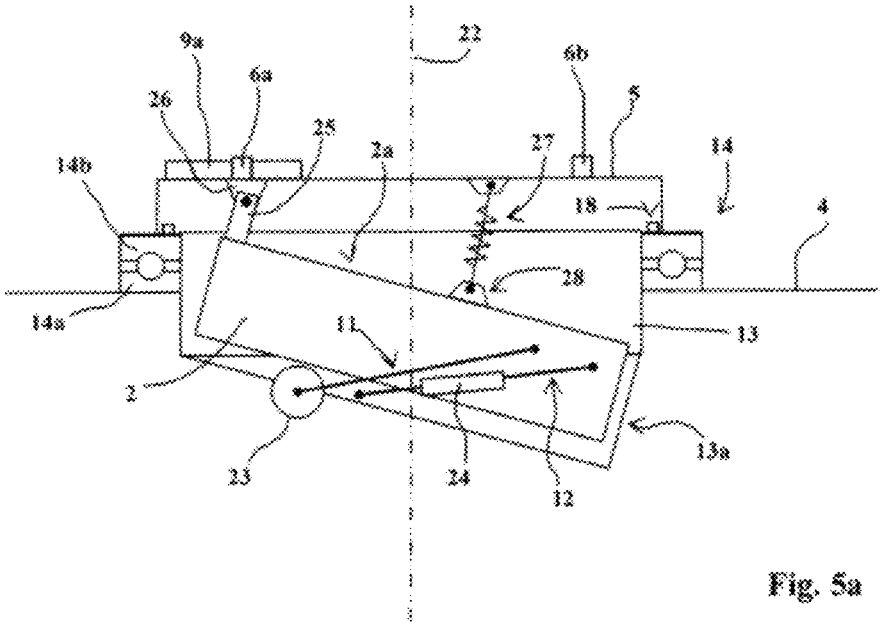
FIGS. 5*a* and 5*b* are two schematic drawings of a section view of the light turret enabling the kinematics of the deployment process to be visualised.
Figure 5B:
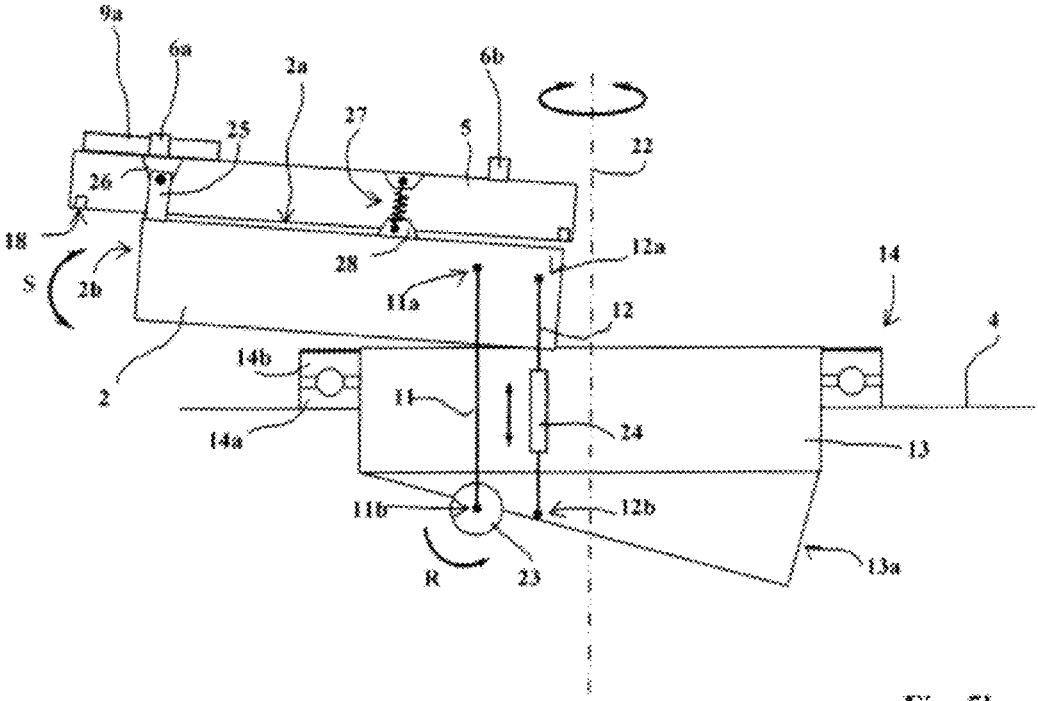

As may be seen more particularly in FIGS. 5*a* and 5*b*, the firing means 2 are supported on either side by a pair of arms 11 and 12 that enable it to be moved from a retracted position to a deployed position. The two pairs of arms 11, 12 are arranged on either side of the firing means 2 and linked firstly to these means by a pivot link and secondly to a caisson 13, itself integral with the mobile part of an azimuth positioning ring 14.

Figure 4:
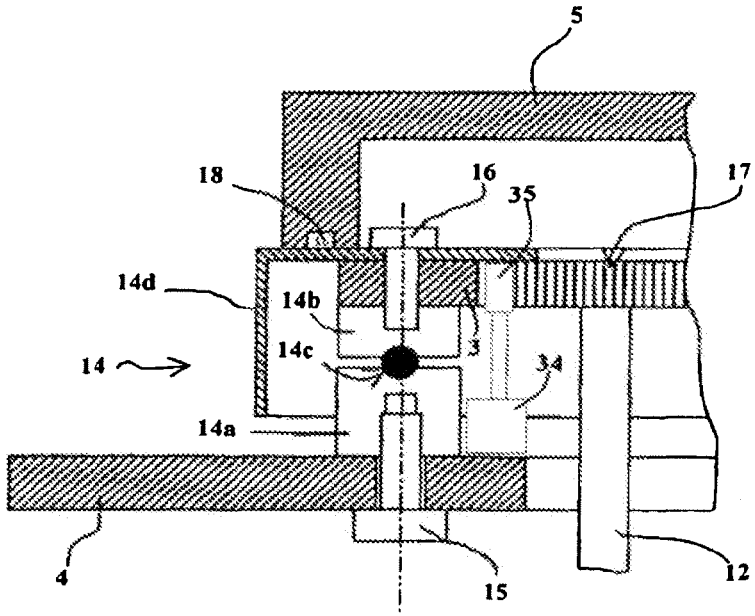
FIG. 4 is a detailed view of the assembly of the ring.

FIG. 4 shows the assembly of this ring 14 in greater detail. The ring 14 comprises a mobile part 14*b*, a fixed part 14*a* and bearing means 14*c* so as to make a pivot link between the light turret 1 and the platform 4 on which it is mounted.

The fixed part 14*a* is fixed to the platform 4 by screws 15. The mobile part 14*b* carries the caisson 13 that is fixed by other screws 16. Furthermore, circular toothing 17 is integral with caisson 13. A pinion 35 is driven by a motor 34 integral with the fixed part 14*a* of the ring. The ring 14 thus forms a pivot enabling the azimuth aiming of the light turret.

This pivoting is possible whether the light turret 1 is deployed or not by means of the opening 3. A cowling 14*d* covers the ring 14 and ensures the protection of the bearing means 14*c*. It is integral with the mobile part 14*b*.

FIG. 1 shows the turret according to the invention in its retracted position. As can be seen, in this configuration, the cowling 5 presses on the ring 14 thereby providing sealing with respect to the exterior of the platform. A circular seal 18 (see FIGS. 4, 5*a*, 5*b*) is applied to the upper face of the ring 14 when the firing means 2 are in their retracted position.

FIG. 2 more particularly shows the caisson 13 inside which the firing means 2 are housed in their retracted position. The caisson 13 forms a closed enclosure that provides sealing between the exterior and the interior of the platform 1. To this end, the caisson 13 incorporates a shutter that is provided with a seal and which enables a rear face of the caisson to be closed at opening 20. This shutter 19 provides access to the firing means 2 when these are in their retracted position. The shutter 19 also ensures sealing of the whole assembly with respect to the exterior once the light turret 1 is in its deployed position. This shutter, once the turret is in its retracted position, tips over so as to enable the replenishment of ammunition from inside the platform 4. We note that the shape of the opening 20 in the caisson 13 substantially matches that of the shutter 19 so as to cooperate with it and ensure the sealing of the device when the turret is deployed. Moreover, the caisson 13 is integral with the mobile part of the ring 14. Thus, reloading is possible in all the positions of the turret over the complete turning area)(360°).

A firing plate 21 comprising a percussion system is locked at the rear part of the firing means 2 and ensures the firing chain for the selected ammunition. Locking means (not shown) enable the mobile firing plate 21 to be held in a locked position.

As can be seen in FIG. 2, the firing means 2 are constituted by a parallelepipedic unit that incorporates boreholes 33*a*, 33*b* of different calibres. Here, two rows of eight 40 mm calibre boreholes 33*a* are shown and one row of six 56 mm calibre bores 33*b*. These boreholes are intended to accommodate low velocity grenades. Such ammunition of one or other calibre is standard, commercially available ammunition. The fact of providing boreholes of different calibres on a single firing means 2 enables the firing means 2 to be used with all the ranges of ammunition presently available on the market.

Classically, ammunition of different types (smoke-producing, lachrymatory, flares, anti-personnel) is recognised by a marker (mechanical or electronic chip). The type of ammunition present in a given tube is thus detected by the firing means 2 (using appropriate sensors integral with the firing plate 21). The turret operator is thus able to control at any time the firing of the type of ammunition he wishes.

FIGS. 5*a* and 5*b* schematise an embodiment of the internal architecture of the light turret 1 and namely show the kinematics of the deployment of the firing means 2 using arms 11 and 12.

FIG. 5*a* shows the light turret 1 in its retracted position. We can see that the firing means 2 are housed inside the caisson 13 and that the latter has a profile that is inclined with respect to the pivoting plane of the ring 14 (horizontal plane of the platform 4). Thus, the rear face 13*a* of the caisson is oriented towards the interior of the platform 4 and provides easy access to the firing means 2 when the latter is in its retracted position.

FIGS. 5*a* and 5*b* do not show the shutter 19 that closes the caisson 13 at its rear face 13*a*. The caisson 13 is integral with the mobile part 14*b* of the ring 14. Thus, the caisson 13 can be pivoted around the vertical axis 22 to enable it to be aimed in azimuth.

FIGS. 5*a* and 5*b* show that the firing means 2 can be moved from their retracted position to their deployed position using at least one pair of arms 11 and 12 that form a deformable parallelogram. Arms 11 and 12 are fixed at one end to the caisson 13 and at the other end to the firing means 2. The attachments 11*a*, 11*b*, 12*a*, 12*b* are constituted by pivot hinges. The lower end 11*b* of arm 11 is furthermore integral with a shaft driven by a motor 23. Activating the motor 23 (rotation R) moves the active system from its retracted position (FIG. 5*a*) to its deployed position (FIG. 5*b*). The attachments 11*a*, 11*b*, 12*a*, 12*b* are selected by the Expert such that the deformable parallelogram formed by arms 11, 12 ensures the required deployment kinematics. We can see that in the deployed position (FIG. 5*b*) the firing means 2 are offset to the fore of axis 22 and slightly inclined upwards. Arms 11 and 12 are thus in a substantially vertical orientation.

According to another characteristic, one of the arms 12 of the deformable parallelogram has a length that can be modified by an actuator 24. Advantageously, this characteristic is ensured by making the arm 12 in the form of a linear jack 24.

Such an arrangement enables aiming in elevation (arrow S) of the firing means 2 when it is in its deployed position. The modification of the length of arm 12 causes the firing means 2 to pivot around the hinge 11*a* of the fixed arm 11.

FIGS. 5*a* and 5*b* also show the assembly of the cowling 5 on the firing means 2. The upper face 2*a* of the firing means has lugs 25 on its front part that receive hinges 26 integral with the cowling 5. Furthermore, at least one spring means 27 is fastened between the cowling 5 and a lug 28 fixed on the upper face 2*a* of the firing means 2, in the vicinity of a rear part.

When the light turret is in its retracted position (FIG. 5*a*), we can see that the spring 27 is stretched. The load exerted by the spring means 27 enables the cowling 5 to be held tightly against the ring 14 in the retracted position. The seal 18 is thus compressed.

When the firing means move into their deployed position, the spring means make the cowling pivot with respect to the firing means around the hinge 26. This ensures that the front face 2*b* of the firing means 2 is disengaged in the deployed position. The cowling 5 is thus unable to obstruct the firing of the ammunition.

Figure 3:
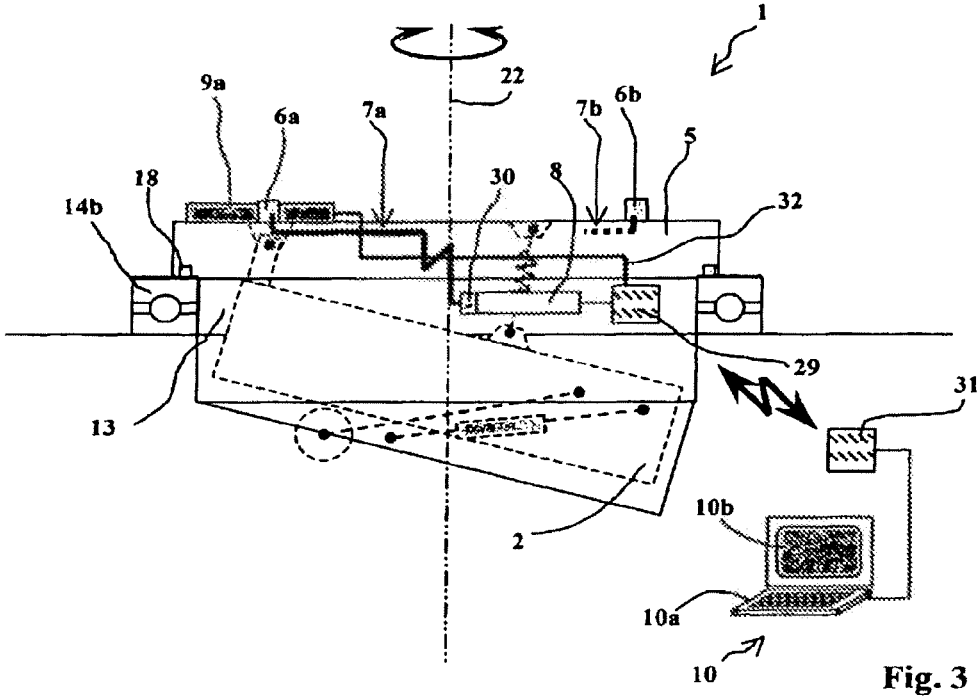
FIG. 3 is a schematic lateral view showing the main organs of the light turret according to the invention.

Similarly to FIG. 5*a*, FIG. 3 shows the light turret 1 in the retracted position. In this Figure, the arrangements related to the close-in defence means and the observation means are detailed.

We can thus see that the cowling 5 has dispersion nozzles (although only nozzles 6*a*, 6*b* can be seen in this Figure) and observation means or aiming means 9 (only one camera 9 can be seen here) on its upper face. We note that dispersion nozzle 6*a* is linked by a manifold 7*a* to a pressurised storage container 8 that is integral with the caisson 13. The nozzle 6*b* is linked to another container (not shown) by another manifold 7*b*. Furthermore, a control box 29 (integral with the caisson 13) is linked firstly to cameras 9 and secondly to valves 30 enabling the storage containers 8 to be opened (one valve per container). The manifolds 7*a*, 7*b* as well as the cables 32 linking the cameras/targeter 9*a*, 9*b* and 9*c* to the box 29 will be long enough to ensure the opening of the cowling 5 and the deployment of the firing means 2.

The box 29 incorporates short-range radio transmission means which enable it to exchange data with a relay box 31 linked to the display means, which is, for example, a display screen 10*b* linked to a computer 10*a*. The box 29 thus transmits images supplied by cameras 9*a*, 9*c* to the screen 10*b*. It also ensures the transmission to the valves 30 of the commands to control the opening of the storage containers 8, such commands being supplied by a remote control (here the computer 10*a*) via the relay box 31.

In the retracted position shown in FIG. 3, the cowling 5, which is pressing on the mobile part 14*b* of the ring 14, is able to pivot in azimuth around axis 22.

It is thus possible for the operator located in the platform to orient the close-in defence means 6*a* and 6*b* to counter a threat detected using observation means 9*a* and 9*c*. Rapid defence at very close range is thus possible without it being necessary to deploy the device. Attackers may therefore be dispersed using lachrymatory means or a fire (caused for example by a Molotov cocktail) can be put out using the fire-extinguishing means. Using the computer 10*a*, the operator will control both the movements of the turret 1 and the valves 30 enabling the content of the storage containers 8 to be released through the dispersion nozzles 6*a* and 6*b*.

We note that the two nozzles (6*a* or 6*b*) dispersing a given type of agent are arranged diametrically to one another. The positioning of one type of nozzle with respect to a given threat is thereby made easier, a quarter turn of the cowling 5 being required at most to orient one type of nozzle (6*a* or 6*b*) to face a detected threat.

To counter a threat located at medium or long range, the operator will activate: the deployment of the firing means 2, the positioning in elevation and in azimuth of the turret 1 then the firing of one or several rounds of the ammunition of the required type. Naturally, the choice of ammunition, the deployment and positioning of the firing means and the firing will be controlled using the computer 10*a*. Cameras 9*a*, 9*c* will naturally also be able to be used (as will the targeter 9*b*) when the firing means 2 are in their deployed position.

It is naturally possible to implement the invention with firing means that will be deployed and positioned using means of a different structure. A simplified light turret may thus be implemented in which there is only one set of arms 11, 12 fixed to a lateral face of the firing means, or else a turret in which the elevation and azimuth positioning controls are ensured manually.

What is claimed is:

1. A retractable light turret mounted on a platform, the retractable light turret comprising:

a firing means capable of deployment through an opening in the platform;

a protective cowling ensuring closing of the opening;

elevation aiming means for the firing means; and, azimuth aiming means for the firing means;

wherein said protective cowling has an external surface comprising:

close-in defense means;

at least one observation means coupled with display means, the display means arranged inside said platform.

2. A retractable light turret according to claim 1, wherein said close-in defense means comprise at least one means for dispersing a lachrymatory agent.

3. A retractable light turret according to claim 2, wherein said close-in defense means comprise at least one means for dispersing a fire-extinguishing agent.

4. A retractable light turret according to claim 2, wherein said means for dispersing said lachrymatory agent is linked to at least one pressurized storage container inside said platform.

5. A retractable light turret according to claim 3, wherein said means for dispersing said fire-extinguishing agent is linked to at least one pressurized storage container inside said platform.

6. A retractable light turret according to claim 1, wherein said protective cowling bears at least one target designation means on the external face of the cowling.

7. A retractable light turret according to claim 1, wherein said protective cowling is integral with said firing means and can pivot in azimuth with said firing means both in its open position and in its closed position, thereby enabling said close-in defense means and said observation means to be oriented.

8. A retractable light turret according to claim 7, wherein said firing means is moveable from a retracted position into a deployed position by means of at least one pair of arms forming a deformable parallelogram.

9. A retractable light turret according to claim 8, wherein the length of one of said arms of said deformable parallelogram can be modified by an actuator thereby enabling aiming in elevation of said firing means in said deployed position.

10. A retractable light turret according to claim 1, wherein said firing means comprise a unit having at least two boreholes each for accommodating a projectile.

11. A retractable light turret according to claim 10, wherein said two boreholes are of different calibers.

* * * * *